US006052337A

United States Patent [19]

Yuzuki et al.

[11] Patent Number: 6,052,337

[45] Date of Patent: Apr. 18, 2000

[54] ELECTRONIC WATCH

[75] Inventors: Toshiyuki Yuzuki, Chiba; Kenji Hayashi, Suwa, both of Japan

[73] Assignees: Seiko Instruments Inc.; Seiko Epson Corporation

[21] Appl. No.: 09/065,984

[22] Filed: Apr. 24, 1998

[51] Int. Cl.[7] ..... G04F 5/00

[52] U.S. Cl. ..... 368/157; 368/160

[58] Field of Search ..... 368/157–160; 318/696

[56] References Cited

U.S. PATENT DOCUMENTS 4,491,424 1/1985 Ito et al. ..... 368/157

*Primary Examiner*—Bernard Roskoski
*Attorney, Agent, or Firm*—Adams & Wilks

[57] ABSTRACT

The reference voltage of the rotation detecting comparator is set to the constant voltage circuit used in another circuit. However, because the constant voltage circuit used in another circuit has a constant voltage value suitable for its original purpose, a voltage is inputted to the rotation detecting comparator from an arbitrary location of a resistant element which is connected in series to a coil that affects a value of the rotation VRS and the non-rotation VRS. With this structure, a voltage value to be detected which is inputted to the rotation detecting comparator can be lowered as much as the resistant ratio with the voltage of the VRS per se being not changed, so that rotation or non-rotation can be detected even by the reference voltage of the constant voltage circuit which is used in another circuit.

3 Claims, 5 Drawing Sheets

ELECTRONIC WATCH

BACKGROUND OF THE INVENTION

The present invention relates to an improvement of an electronic watch, in particular to an electronic watch for reduction of current consumption of an integrated circuit (hereinafter referred to as "IC") and for reduction in size of the IC.

In general, a reference voltage of a comparator circuit (hereinafter referred to as "comparator") has been used as a given value using a constant voltage without depending on a supply voltage. However, when a constant voltage circuit exclusive to the reference voltage of a rotation detecting comparator is employed in an IC for an electronic wristwatch, a circuit structure becomes increased in size, and in the case where a volume is restricted as in the electronic wristwatch, an IC area is reduced as much as possible, as a result of which the constant voltage circuit is unsuitable for the IC of the electronic wristwatch. For that reason, the reference voltage of the rotation detector circuit in the electronic wristwatch as conventionally used is the supply voltage or a voltage obtained by dividing the supply voltage by resistance.

FIG. 2 shows an example of the periphery of a rotation detector circuit using a voltage obtained by dividing the supply voltage by resistance as the reference voltage of the rotation detector circuit in a conventional electronic watch.

The respective gates of a detection element Pch-Tr 201, a detection element Pch-Tr 202, a motor driver Pch-Tr 205, a motor driver Pch-Tr 206, a motor driver Nch-Tr 207 and a motor driver Nch-Tr 208 are connected to a pulse synthesizing circuit not shown which synthesizes signals divided according to a reference signal from an oscillator circuit to produce a drive pulse, a correction pulse, a rotation detection pulse and so on. A voltage (minus side input terminal) of a rotation detecting comparator 210 at a detected side thereof is a terminal voltage (hereinafter referred to as "VRS") of a resistant element 203 or 204 which is developed when applying the rotation detection pulse thereto. On the other hand, a reference (plus side input terminal) is a voltage obtained by dividing the supply voltage by a reference voltage resistor 211 and a reference voltage resistor 212. The rotation or non-rotation is detected according to whether the VRS is larger than the reference voltage or not. Also, the VRS during rotation (hereinafter referred to as "rotation VRS") is in proportional to the fluctuation of the supply voltage whereas the VRS during non-rotation (hereinafter referred to as "non-rotation VRS") has a characteristic such that it is a given value without almost depending on the fluctuation of the supply voltage.

In the case where the reference voltage is a supply voltage or a voltage obtained by dividing the supply voltage by resistance, the reference voltage of the rotation detecting comparator is also caused to fluctuate according to the fluctuation of the supply voltage. For that reason, a stepping motor is designed taking the fluctuation of the reference voltage into account. Then, in the case where the reference voltage is the supply voltage, there is the possibility of detecting an actually rotating state as non-rotation in error because there is not a large difference between the reference voltage and the rotation VRS. In order to prevent such misdetection, the stepping motor is designed such that the rotation VRS is highly outputted. However, even if the design constant of the stepping motor is changed, a value of the rotation VRS is not largely changed. Therefore, in the case where the reference voltage is a voltage obtained by dividing the supply voltage by resistance, the reference voltage can be set to an arbitrary voltage, which is most useful. However, because resistors are required, and also high resistance is required to suppress current consumption, an area of the IC is increased.

SUMMARY OF THE INVENTION

It is an object of the present invention to provide an electronic watch wherein for the reference voltage of the rotation detecting comparator, the voltage of the constant voltage circuit necessary for another circuit is commonly used with the result that the reference resistor which has been used for producing an optimum reference voltage up to now is deleted without any addition of circuits, thereby being capable of reducing current consumptiion and reducing the IC size.

It is another object of the present invention to provide an electronic watch wherein the value of the non-rotation VRS can be lowered since the detected side input of the rotation detecting comparator is taken from an arbitrary position of the variable resistant element that adversely affects the value of the rotation VRS and the non-rotation VRS.

It is a further object of the present invention to provide an electronic watch wherein parts can be commonly used, thereby being capable of expecting the effect of the reducted costs since the degree of freedom of designing the stepping motor (the number of winding and the line diameter of the coil, the material of the stator) using the 3V drive IC is increased.

DETAILED DESCRIPTION OF THE PREFERRED EMBODIMENTS

In order to solve the above problems, the reference voltage of the rotation detecting comparator is set to the voltage of the constant voltage circuit used in another circuit (for example, an oscillation system constant voltage circuit that supplies a constant voltage to the oscillator circuit or a logic section of the oscillator circuit, the divider circuit or the pulse synthesizing circuit, or a display system constant voltage circuit that applies a constant voltage to a display drive circuit). However, because the constant voltage circuit used in another circuit has a constant voltage value suitable for its original purpose, the voltage is not always a voltage value that enables rotation or non-rotation to be detected without any change. Therefore, a voltage is inputted to the rotation detecting comparator from an arbitrary location of a resistant element (hereinafter referred to "variable resistant element") which is connected in series to a coil that affects a value of the rotation VRS and the non-rotation VRS. With this structure, a voltage value to be detected which is inputted to the rotation detecting comparator can be lowered as much as the resistant ratio with the voltage of the VRS per se being not changed, so that rotation or non-rotation can be detected even by the reference voltage of the constant voltage circuit which is used in another circuit.

Figure 1:
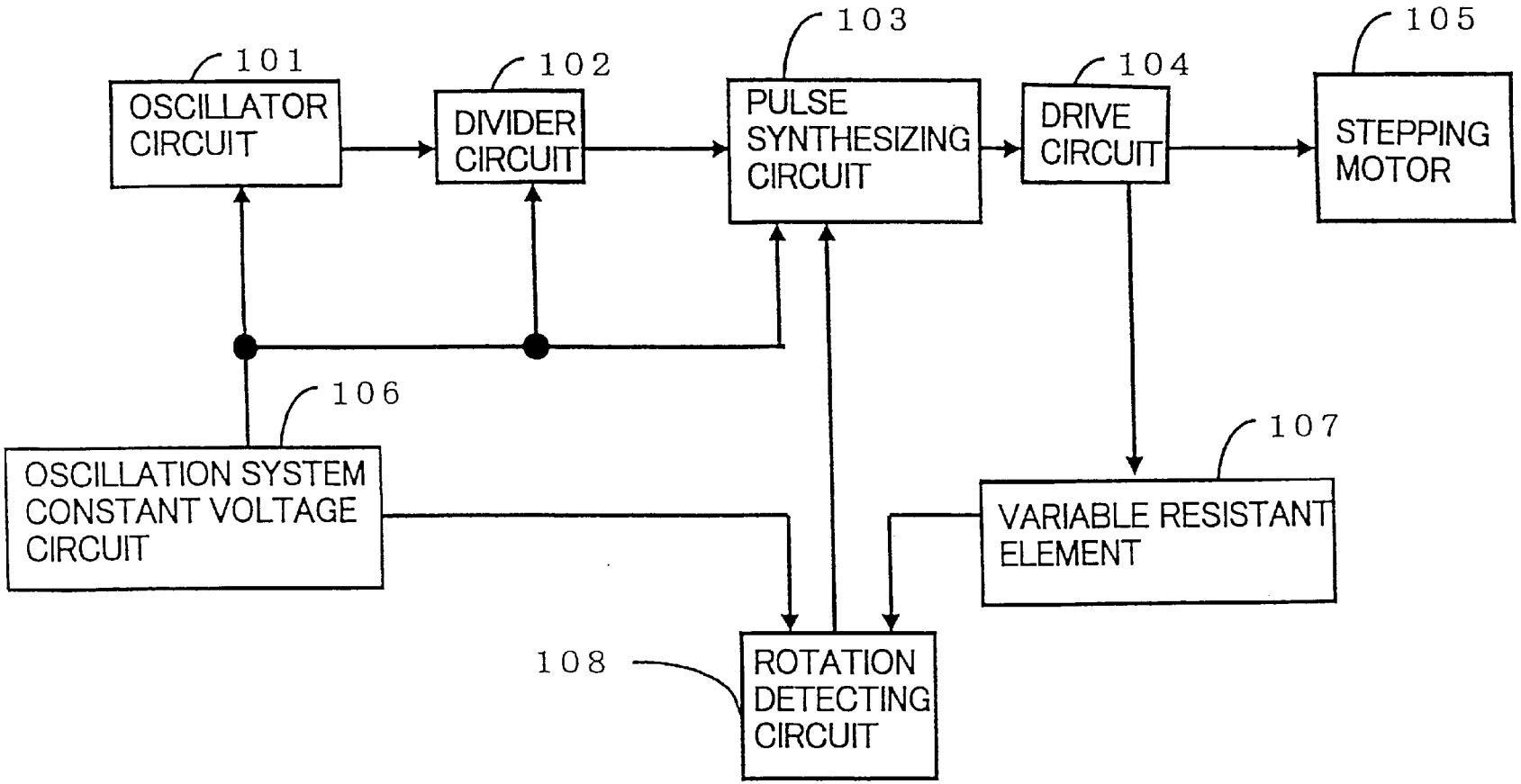
FIG. 1 is a schematic systematic block diagram showing the present invention.

Hereinafter, the present invention will be described with reference to the accompanying drawings. FIG. 1 is a block diagram showing the outline of a system according to the present invention.

An input/output signal in FIG. 1 will be described. A dividing circuit 102 inputs an output signal from an oscillator circuit 101 and outputs an output signal to a pulse synthesizing circuit 103. A drive circuit 104 inputs an output signal from the pulse synthesizing circuit 103 and outputs an output signal to a stepping motor 105 and a variable resistant element 107. An oscillation system constant voltage circuit 106 outputs an output signal to the oscillator circuit 101, the divider circuit 102, the pulse synthesizing circuit 103 and a rotation detector circuit 108. The rotation detector circuit 108 inputs an output siginal from the oscillation system constant voltage circuit 106 and an output signal from the variable resistant element 107 and outputs an output signal to the pulse synthesizing circuit 103.

Subsequently, the structure of the respective circuits will be described. The oscillator circuit 101 generates a reference signal in accordance with quartz oscillation (in general, 32 kHz for a watch) or CR oscillation due to a resister R and capacitor C. The divider circuit 102 divides the output signal from the oscillator circuit 101. In the case of producing a signal of 1 Hz (1 second in a period) using a 32 kHz quartz, 15 T-flip flop circuits are connected in series. The pulse synthesizing circuit 103 synthesizes a drive pulse, a correction pulse, a rotation detection pulse or the like in accordance with the output signal from the divider circuit 102 to selectively output the output signal. The drive circuit 104 inputs the output signal of the pulse synthesizing circuit 103 to drive the stepping motor 105 which is made up of a stator, a rotor and a coil. Also, the drive circuit 104 drives the detecting comparator so as to allow a voltage to be detected of the detecting comparator to be developed at the time of detecting rotation. The oscillator circuit 101, the divider circuit 102 and the pulse synthesizing circuit 103 are weak with respect to rapid voltage fluctuation and consume a large amount of current because of high-frequency operating circuits in the ICs for a watch. For that reason, a constant output voltage lower than the supply voltage of the oscillation system constant voltage circuit 106 is used as a power supply, to thereby realize a low-current-consumption drive without any influence of a fluctuation of the power supply voltage. The variable resistant element 107 is made up of at least two resistant elements (diffusion resistors, polysilicon resistors, etc.,) or elements having a function equivalent to that of the resistant element (for example, an on-resistance of a MOSFET, etc.,), which are connected to each other, and a joint therebetween is connected to a detected-side input of the rotation detecting comparator according to selection. The rotation detector circuit 108 inputs a constant voltage of the oscillation system constant voltage circuit 106 as a reference voltage. Also, the circuit is a comparator that inputs a voltage developed at the selected joint of the variable resistant element 107, compares the voltage with the reference voltage and outputs a comparison result to the pulse synthesizing circuit 103.

Figure 3:
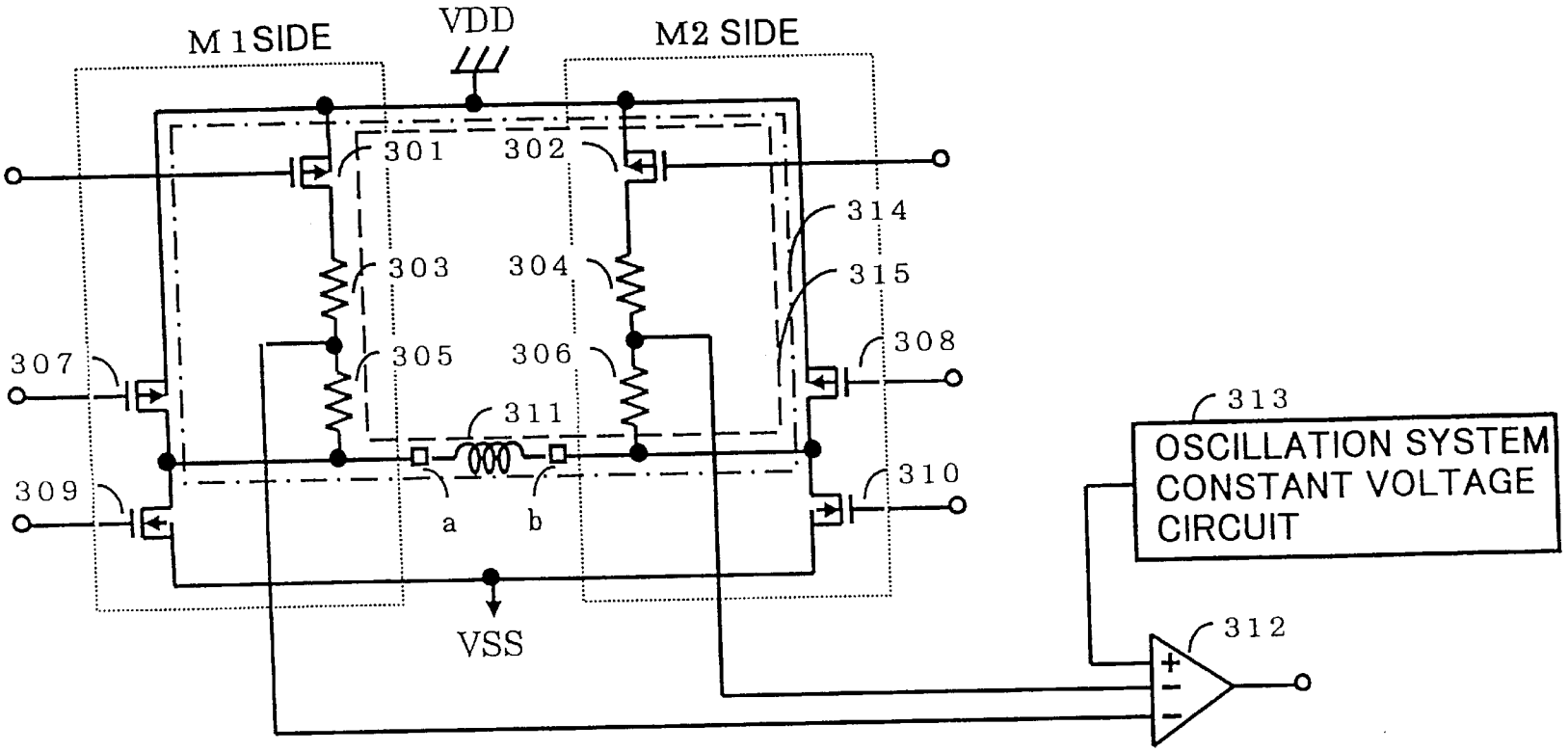
FIG. 3 is a diagram showing a motor driver and a rotation detector circuit of an electronic watch in accordance with an embodiment of the present invention.

Referring to FIG. 3, a description will be given of a motor driver and a rotation detector circuit of an electronic watch in accordance with an embodiment of the present invention, and their basic operation.

First, the circuit connection of FIG. 3 will be described. The respective sources of a detection element Pch-Tr 301, a detection element Pch-Tr 302, a motor driver Pch-Tr 307, and a motor driver Pch-Tr 308 are connected to VDD, and the respective sources of a motor driver Nch-Tr 309 and a motor driver Nch-Tr 310 are connected to VSS. A resistor 303 and a resistor 305 as well as a resistor 304 and a resistor 306 are connected to each other, respectively, and the respective joints are inputted to a minus side input terminal of the rotation detecting comparator 312. To a plus side input terminal of the rotation detector comparator 312 is inputted a voltage of the oscillation system constant voltage circuit that applies a constant voltage to the oscillator circuit. Another side of the resistor 303 is connected to a drain of the detection element Pch-Tr 301, and another side of the resistor 304 is connected to a drain of the detection element Pch-Tr 302.

Another side of the resistor 305 is connected to a terminal a of a coil 311 at one side thereof, and another side of the resistor 306 is connected to a terminal b of a coil 311 at another side thereof. The drain of the motor driver Pch-Tr 307 and the drain of the motor driver Pch-Tr 309 are connected to the terminal a of the coil 311. Also, the drain of the motor driver Pch-Tr 308 and the drain of the motor driver Pch-Tr 310 are connected to the terminal b of the coil 311. The respective gates of the detection element Pch-Tr 301, the detection element Pch-Tr 302, the motor driver Pch-Tr 307, the motor driver Pch-Tr 308, the motor driver Nch-Tr 309 and the motor driver Nch-Tr 310 are connected to a pulse synthesizing circuit (not shown) which synthesizes a signal divided in accordance with the reference signal from the oscillator circuit and produces a drive pulse, a correction pulse, a rotation detection pulse and so on.

Hereinafter, the operation of the motor driver during a normal indicator movement and a rotor principle of the rotor will be described.

In the operation of the motor driver during the normal indicator movement, first, in the case where a drive pulse is outputted form an M1 side, the motor driver Pch-Tr 307 and the motor driver Nch-Tr 310 are turned on, and other transistors are turned off in such a manner that a current flows in the VDD, the motor driver Pch-Tr 307, the coil 311, the motor driver Nch-Tr 310 and the VSS, in the stated order. The current flowing in the coil in this situation allows a magnetic field to be developed in the stator, which makes the rotor rotate, to thereby move indicators. Then, in the case where the drive pulse is outputted form an M2 side, the motor driver Pch-Tr 308 and the motor driver Nch-Tr 309 are turned on, and other transistors are turned off in such a manner that a current flows in the VDD, the motor driver Pch-Tr 308, the coil 311, the motor driver Nch-Tr 309 and the VSS, in the stated order. Thus, the direction of the current flowing in the coil 311 at this time is opposite to that as aforementioned. However, since the rotor is already rotated, the operation of rotating in the same direction is repeated.

Subsequently, a method of detecting the rotation or non-rotation of the rotor will be described.

Now, if the drive pulse is outputted from the M1 side, the current is not allowed to forcedly flow in the coil after the drive pulse is outputted as described above. Therefore, the rotor starts to freely vibrate regardless of rotation or non-rotation. The free vibration of the rotor conversely generates a current. In this situation, when the detection element Pch-Tr 301 is turned in an on-state, and the motor driver Pch-Tr 307 is turned on by chopping (on/off) due to sampling pulses, there is formed a close circuit 314 which is made up of the VDD, the motor driver Pch-Tr 308, the coil 311, a synthetic resistor consisting of the resistor 303, the resistor 305, the detection element Pch-Tr 301 and the motor driver Pch-Tr 307 (in general, since the on-resistance of the transistor in the motor driver is about several tens to several hundreds, and the resistor thereof is several hundreds k, the synthetic resistance of the circuit in FIG. 3 becomes low) and the VDD. A relatively large current flows in the close circuit 314.

On the other hand, when the motor driver Pch-Tr 307 is turned off, there is formed a close circuit 315 which is made up of the VDD, the motor driver Pch-Tr 308, the coil 311, a synthetic resistor consisting of the resistor 303, the resistor 305 and the detection element Pch-Tr 301 (since the on-resistance of the transistor is about several tens to several hundreds Ω, and the resistor thereof is several hundreds kΩ as mentioned above, the synthetic resistance of the circuit in FIG. 3 becomes high) and the VDD. A relatively small current flows in the close circuit 315. Since the inductance of the coil 311 is large, the coil 311 cannot follow a variation in those currents and exhibits a response of a first-order lag of a time constant $\tau=L/R$ due to an inductance L of the synthetic resistor R and the coil 311. As a result, an instantaneous coil 311 which is switched to the close circuit 315 tries to allow a current occurring at the time of the close circuit 314 to continuously flow as it is, a high voltage (VRS) is instantaneously developed at a joint of the resistor 303 and the resistor 305 each having a high resistance, and thereafter this high voltage is attenuated by the time constants $\tau=L/R$. The voltage is detected by the rotation detecting comparator 312. Also, because the free vibration of the rotor during rotation is larger than that during non-rotation, a large VRS is generated when the rotor is rotated whereas a small VRS is generated when the rotor is non-rotated.

Also, similarly, in the case where the drive pulse is outputted from the M2 side, when the detection element Pch-Tr 302 is turned in an on-state, and the motor driver Pch-Tr 308 is turned on by chopping (on/off) due to sampling pulses, there is formed a close circuit which is made up of the VDD, the motor driver Pch-Tr 307, the coil 311, a synthetic resistor consisting of the resistor 304, the resistor 306, the detection element Pch-Tr 302 and the motor driver Pch-Tr 308 (the synthetic resistance becomes low) and the VDD. A relatively large current flows in the close circuit. On the other hand, when the motor driver Pch-Tr 308 is turned off, there is formed a close circuit which is made up of the VDD, the motor driver Pch-Tr 307, the coil 311, a synthetic resistor consisting of the resistor 304, the resistor 306 and the detection element Pch-Tr 302 (the synthetic resistance becomes high) and the VDD. A relatively small current flows in the close circuit.

Then, the operation of the rotation detecting comparator 312 will be described. The rotation detecting comparator 312 inputs a constant voltage (hereinafter referred to as "VREG") produced by the oscillation system constant voltage circuit 313 having a reference voltage at a plus side terminal thereof. Then, to its minus side terminal is inputted a voltage at the joint between the resistor 303 and the resistor 305 and a voltage at the joint between the resistor 304 and the resistor 306, which are voltage points to be detected, respectively. As a result, the comparator is so designed as to judge that the state is rotation when $|VRS| \geqq |VREG|$, and to judge that the state is rotation when $|VRS| < |VREG|$. In FIG. 3, the division of a voltage to be detected is made at one point, however, it may be selected among a plurality of points in accordance with a design value of the stepping motor.

Figure 2:
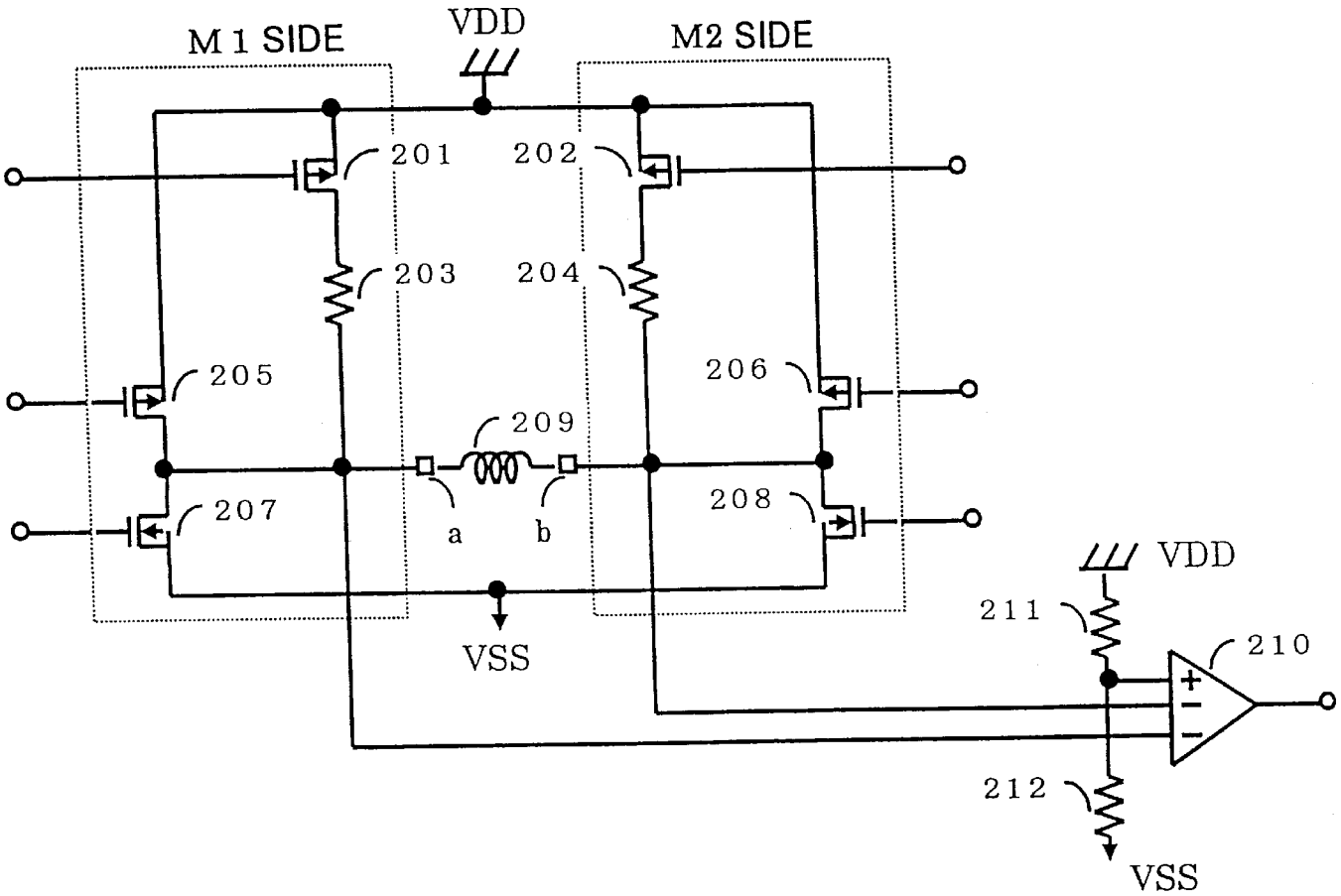
FIG. 2 PRIOR ART
FIG. 2 is a circuit diagram showing an example of the periphery of a rotation detector circuit using a voltage obtained by dividing the supply voltage by resistance as the reference voltage of the rotation detector circuit in a conventional electronic watch.

Now, the circuit of FIG. 2 which is the conventional example and the circuit of FIG. 3 which is this embodiment of the present invention will be compared through simulation.

Figure 5:
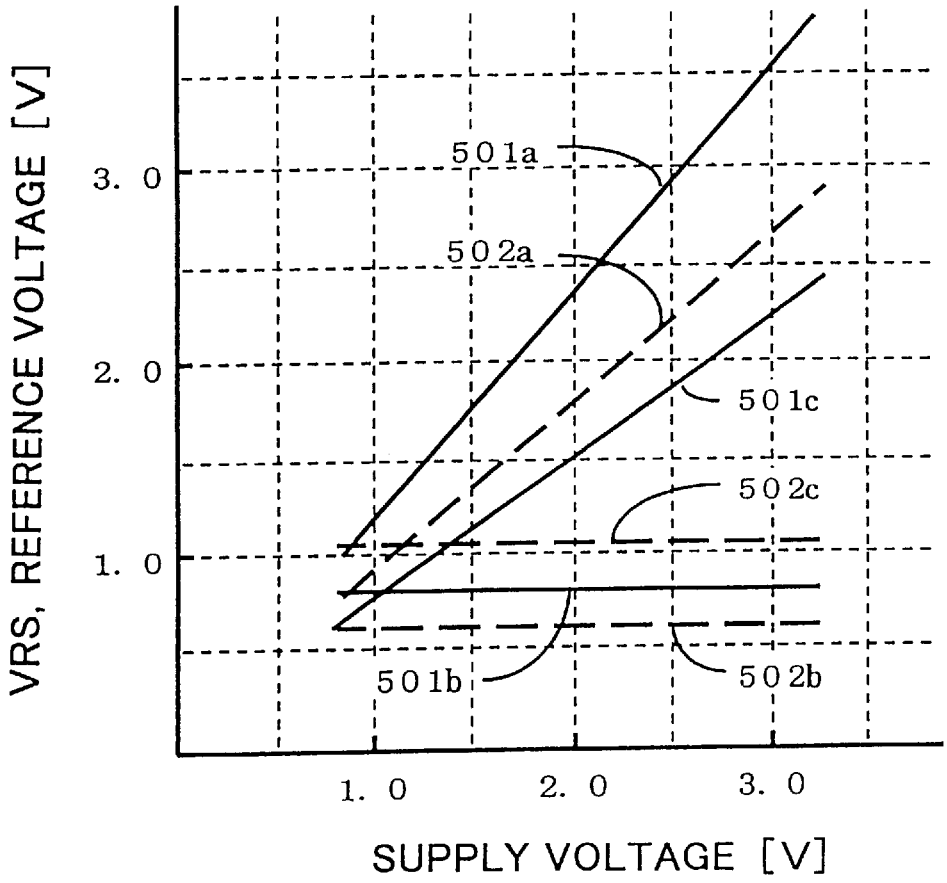
FIG. 5 is a graph showing simulation of the characteristics of rotation VRS, non-rotation VRS and a reference voltage when a supply voltage is varied in the circuits structures of the present invention and the prior art.

In FIG. 2, it is assumed that the reference voltage (VREG) which is the plus side input of the rotation detecting comparator 210 is set such that the ratio of the reference voltage resistor 211 to the reference voltage resistor 212 is 3:1, and the line diameter and the number of winding of the coil, the rotor and the stator are designed to provide the rotation VRS 501*a*, the non-rotation VRS 501*b* and the VREG 501*c* shown in FIG. 5. Also, it is assumed that in FIG. 3, a voltage point to be detected is provided so that the ratio of the resistor 303 to the resistor 305 or the ratio of the resistor 304 to the resistor 306 is 3:1, and also the reference voltage (VREG) which is the plus side input of the rotation detecting comparator 312 satisfies VREG=1.05 V assuming a constant voltage circuit that supplies a constant voltage as a power supply of the oscillator circuit or the like. The simulation results in the rotation VRS 502*a*, the non-rotation VRS 502*b* and the VREG 502*c* in FIG. 5. Here, the conditions other than the above are identical with that of the circuit shown in FIG. 2. Also, the synthetic resistant value of the resistor 303 and the resistor 305 in FIG. 3, the value of the resistant element 203 in FIG. 2, the synthetic resistant value of the resistor 304 and the resistor 306 in FIG. 3, and the value of the resistant element 204 in FIG. 2 are also identical. Under the above conditions, if the values of the rotation VRS 501*a* and the non-rotation VRS 501*b* are 100%, both of the rotation VRS 502*a* and the non-rotation VRS 502*b* become a voltage lower by 20%. Also, the VREG 502*c* is a constant value without depending on a fluctuation of the supply voltage because of a constant voltage.

Figure 4:
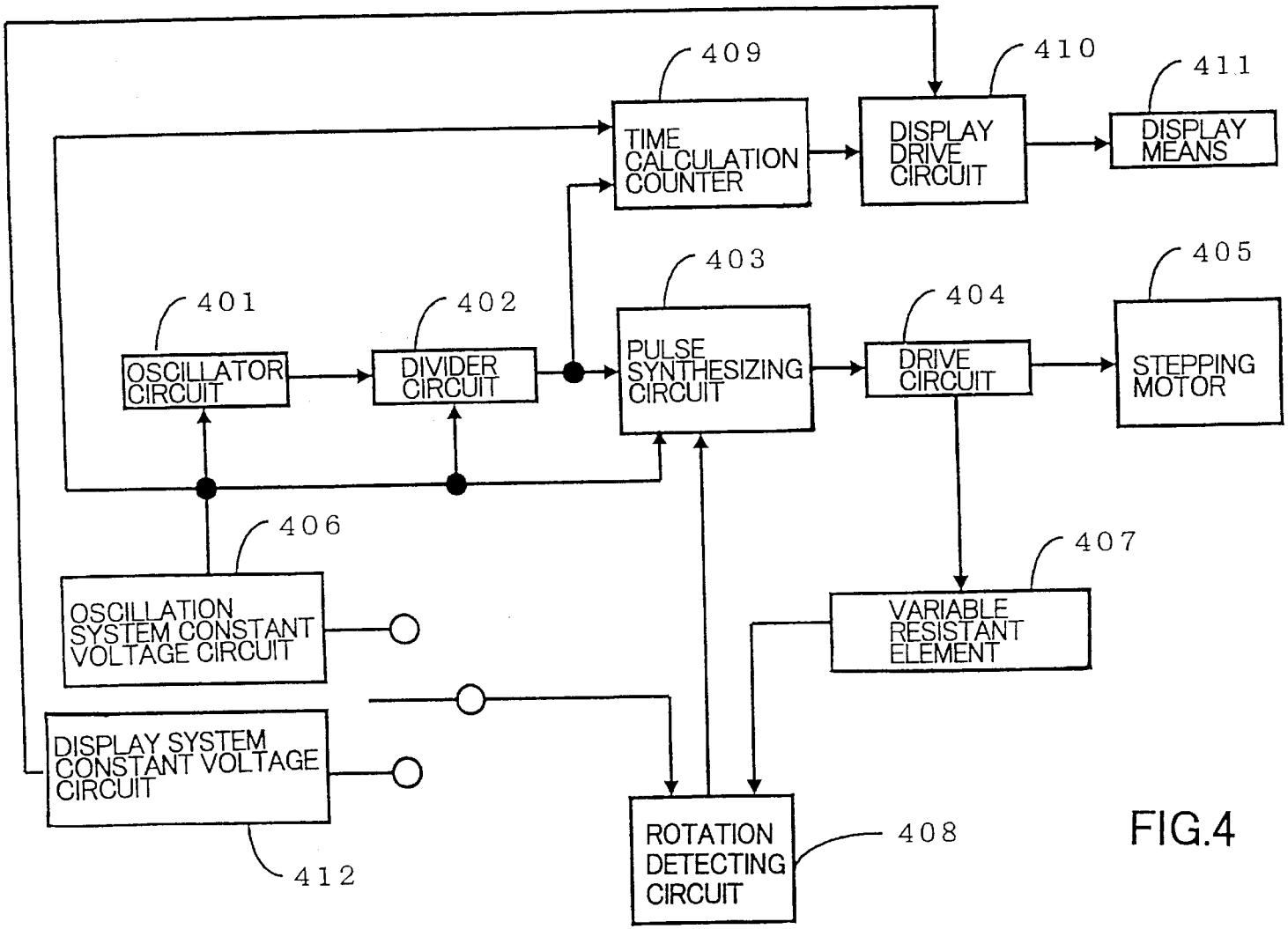
FIG. 4 is a schematic systematic block diagram showing another example of an electronic watch according to the present invention.

FIG. 4 shows a schematic systematic block diagram of another example of an electronic watch according to the present invention.

First, an input/output signal shown in FIG. 4 will be described. A divider circuit 402 inputs an output signal from an oscillator circuit 401 to output an output signal to a pulse synthesizing circuit 403 and a time calculation counter 409. A drive circuit 404 inputs an output signal from the pulse synthesizing circuit 403 to output an output signal to a stepping motor 405 and a variable resistant element 407. A display drive circuit 410 inputs an output signal from the time calculation counter 409 to output an output signal to a display means 411. An oscillation system constant-voltage circuit 406 outputs an output signal to the oscillator circuit 401, the divider circuit 402, the pulse synthesizing circuit 403 and the time calculation counter 409. A display system constant voltage circuit 412 outputs an output signal to the display drive circuit 410. A rotation detector circuit 408 inputs any one of the output signal from the oscillation system constant voltage circuit 406 and the output signal from the display system constant voltage circuit 412 and the output signal from the variable resistant element 407 to output an output signal to the pulse synthesizing circuit 403.

Then, the structure of the respective circuits will be described. The oscillator circuit 401 generates a reference signal due to quartz oscillation (in general, 32 kHz, for a watch), CR oscillation due to a resistor R and a capacitor C, or the like. The divider circuit 402 divides an output signal from the oscillator circuit 401. In the case of producing a signal of 1 Hz (1 second in one period) by 32 kHz quartz, 15 T-flip flop circuits are connected in series. The pulse synthesizing circuit 403 synthesizes a drive pulse, a correction pulse, a rotation detection pulse or the like in accordance with an output from the divider circuit 402 to selectively output an output signal. The drive circuit 404 inputs the output signal from the pulse composing circuit 403 to drive the stepping motor 405 which is made up of a stator, a rotor and a coil.

Also, the drive circuit 404 drives the rotation detecting comparator at the time of rotation detection so as to produce a voltage to be detected of the rotation detecting comparator. The time calculation comparator 409 inputs the output signal from the divider circuit 402, calculates and counts it to output a time information to the display drive circuit 410. The display driver circuit 410 inputs the output signal of the time calculation counter to display the display means 411 such a display element that inputs liquid crystal (LCD), an LED or a digital signal. The oscillator circuit 401, the divider circuit 402, the pulse synthesizing circuit 403 and the time calculation counter 409 are weak with respect to rapid voltage fluctuation and consume a large amount of current because of high-frequency operating circuits in the ICs for a watch. For that reason, a constant output voltage lower than the supply voltage of the oscillation system constant voltage circuit 406 is used as a power supply, to thereby realize a low-current-consumption drive without any adverse influence of a fluctuation of the power supply voltage and with a small amplitude.

The display means 411 such as the display element that inputs the LDC, the LED or the digital signal is adversely affected by an fluctuation of the drive voltage of the display drive circuit 401 such that it is difficult to see the display, etc. Therefore, the display means 411 inputs a constant voltage outputted from the display system constant voltage circuit 412 to eliminate a fluctuation of voltage. The variable resistant element 407 is made up of at least two resistant elements (diffusion resistors, polysilicon resistors, etc.,) or elements having a function equivalent to that of the resistant element (for example, an on-resistance of a MOSFET, etc.,), which are connected to each other, and a joint therebetween is connected to a detected-side input of the rotation detecting comparator according to selection. The rotation detector circuit 408 selectively inputs any one of a constant voltage of the oscillation system constant voltage circuit 406 or a constant voltage of the display system constant voltage circuit 412 as a reference voltage. Also, the circuit is a comparator that inputs a voltage developed at the joint of the variable resistant element 407 as the voltage to be detected, compares the voltage with the reference voltage and outputs a comparison result to the pulse synthesizing circuit 403.

What is claimed is:

1. An electronic watch comprising:

an oscillator circuit;

a divider circuit that divides an output signal from said oscillator circuit;

a pulse synthesizing circuit that synthesizes a drive pulse, a correction pulse, a rotation detection pulse or the like to selectively output it;

an oscillation system constant voltage circuit that applies a constant voltage to said oscillator circuit and a logic section of said oscillator circuit or to said oscillator circuit, said divider circuit and a logic section of said oscillator circuit;

a stepping motor having a stator, a rotor and a coil;

a drive circuit that drives said stepping motor by inputting an output signal from said pulse synthesizing circuit;

a variable resistant element that generates an arbitrary voltage by resistance-dividing at least one end of said coil in accordance with an output of said drive circuit connected to the coil of said stepping motor; and a rotation detecting circuit that inputs a voltage of said oscillation system constant voltage circuit as a reference voltage, compares a detection voltage produced by said variable resistant element to discriminate the rotation or the non-rotation of the rotor of said stepping motor in accordance with the amplitude of said detection voltage value.

2. An electronic watch as claimed in claim 1, comprising:

a time calculation counter that arithmetically processes a time information or the like in accordance with an output from the divider circuit;

a display means such as a display element, etc., which inputs an LCD, an LED or a digital signal;

a display drive circuit that inputs an output signal from said time calculation counter to drive said display means; and a display system constant-voltage circuit that applies a constant voltage to said display drive circuit, wherein the reference voltage of the rotation detector circuit is used as the voltage of said display system constant voltage circuit.

3. An electronic watch as claimed in claims 1 or 2, the reference voltage of the rotation detector circuit can be selected to the voltage of the oscillation system constant voltage circuit or the voltage of the display system constant voltage circuit.

* * * * *